US010953530B2

(12) United States Patent
Cheng

(10) Patent No.: US 10,953,530 B2
(45) Date of Patent: Mar. 23, 2021

(54) REPEATING NAIL-FEEDING STRUCTURE FOR PNEUMATIC NAILING MACHINE

(71) Applicant: ANN-CHAIN ENTERPRISE CO., LTD., Changhua (TW)

(72) Inventor: Hui-Cheng Cheng, Changhua (TW)

(73) Assignee: Ann-Chain Enterprise Co., Ltd., Changhua (TW)

( * ) Notice: Subject to any disclaimer, the term of this patent is extended or adjusted under 35 U.S.C. 154(b) by 194 days.

(21) Appl. No.: 15/888,886

(22) Filed: Feb. 5, 2018

(65) Prior Publication Data

US 2019/0240822 A1 Aug. 8, 2019

(51) Int. Cl.
*B25C 1/00* (2006.01)
*B25C 1/04* (2006.01)

(52) U.S. Cl.
CPC ..... *B25C 1/003* (2013.01); *B25C 1/047* (2013.01)

(58) Field of Classification Search
CPC .... B25C 1/00; B25C 1/04; B25C 1/02; B25C 1/003; B25C 1/047; B25C 3/00; B25C 5/16; B25C 5/1606; B25C 5/1617; B25C 5/13; B25C 1/008; B25C 1/041; B25C 1/005
USPC ..... 227/130, 138
See application file for complete search history.

(56) References Cited

U.S. PATENT DOCUMENTS 5,098,003 A * 3/1992 Young ..... B25C 1/04 227/114
5,231,902 A * 8/1993 Uno ..... B25B 23/045 81/57.44
6,006,975 A * 12/1999 Ishizawa ..... B25C 1/047 227/119
7,556,182 B2 * 7/2009 Murayama ..... B25C 1/08 227/10
7,766,204 B2 * 8/2010 Spasov ..... B25C 5/1627 227/8
7,938,303 B2 * 5/2011 Tamura ..... B25C 1/08 227/10
8,276,798 B2 * 10/2012 Moeller ..... B25C 5/1627 227/120
8,322,006 B1 * 12/2012 Kodi ..... B25C 1/04 29/243.56

(Continued)

FOREIGN PATENT DOCUMENTS

TW I603818 B 11/2017

*Primary Examiner* — Hemant Desai
*Assistant Examiner* — Jacob A Smith
(74) *Attorney, Agent, or Firm* — Muncy, Geissler, Olds & Lowe, P.C.

(57) ABSTRACT

A repeating nail-feeding structure for pneumatic nailing machine, installed in a pneumatic nailing machine, includes an air stream guiding tube, automatic return cylinder, and shifting element. The tube enables working air stream from the machine to enter the cylinder, thereby a piston stein of the cylinder is driven to a retracted position. The piston stein is returned to an extended position by the pressing of a return spring within the cylinder. The shifting element is fixed to the piston stein and provided with a shifting lever. The shifting lever is moved along with the piston stein to advance the strip nail of the machine. Thereby, when the nail is ejected, the strip nail is advanced simultaneously by the discharged working air stream. The requirement of extensive use is fulfilled due to no limitation to length of the strip nail and successive nail-feeding capability.

7 Claims, 3 Drawing Sheets

(56) References Cited

U.S. PATENT DOCUMENTS

| | | | | |
|---|---|---|---|---|
| 2005/0252944 | A1* | 11/2005 | Patrick | B25C 1/04 227/8 |
| 2006/0118596 | A1* | 6/2006 | Wojcicki | B25C 1/003 227/137 |
| 2008/0190988 | A1* | 8/2008 | Pedicini | B25C 1/04 227/130 |
| 2010/0096428 | A1* | 4/2010 | Fujiyama | B25C 1/047 227/8 |
| 2010/0258608 | A1* | 10/2010 | Porth | B25C 1/003 227/9 |
| 2012/0211540 | A1* | 8/2012 | Kondou | B25C 1/008 227/140 |
| 2013/0134204 | A1* | 5/2013 | Morioka | B25C 1/005 227/9 |
| 2013/0228606 | A1* | 9/2013 | Staples | B25C 1/04 227/8 |
| 2013/0320060 | A1* | 12/2013 | Gregory | B25C 1/005 227/8 |
| 2013/0334275 | A1* | 12/2013 | Lam | B25C 1/047 227/8 |
| 2015/0014389 | A1* | 1/2015 | Hoshino | B25C 1/003 227/119 |
| 2015/0114187 | A1* | 4/2015 | Huang | B25C 1/008 81/489 |
| 2015/0174748 | A1* | 6/2015 | Furuta | B25C 1/04 227/130 |
| 2017/0209995 | A1* | 7/2017 | Iijima | B25C 1/043 |
| 2017/0297188 | A1* | 10/2017 | Huang | B25C 7/00 |
| 2017/0326716 | A1* | 11/2017 | Shadwell | B25C 1/003 |

* cited by examiner

REPEATING NAIL-FEEDING STRUCTURE FOR PNEUMATIC NAILING MACHINE

FIELD OF THE INVENTION

The present invention is related to a pneumatic nailing machine, particularly to a nail-feeding structure for a pneumatic nailing machine.

BACKGROUND OF THE INVENTION

A pneumatic tool, such as a pneumatic stapler, is a tool outputting kinetic energy to work by driving a pneumatic motor using compressed air supplied by an air compressor. There are advantages, including faster motion, wide adaptability, operability in rough conditions, such as inflammability, explosibility, dampness, impact and etc., no contamination, long service life, simple construction, easy maintenance and so on.

The stapler is a tool used in building and decorating, in which different workpieces are joined together with staples fired by the stapler. The conventional stapler, such as Taiwan patent no. 1603818, entitled "MAGAZINE ASSEMBLY AND A STAPLER INCLUDING THE SAME", disclosed a magazine assembly and a stapler including the same. The magazine assembly includes a base and a rail assembly. The rail assembly is disposed on the base and adapted for a staple unit to be movably installed thereon. Further, the stapler includes the above-mentioned magazine assembly, and further comprises a pushing part, a casing and a striking plate. The casing is provided with a magazine region accommodating the magazine assembly. A staple-discharging port is defined in the magazine assembly and the casing, and is corresponded to a part of the staple unit. The pushing part and the striking plate are interlinked. When the pushing part is operated from the outside to move with respect to the casing, the striking plate is driven to move in a direction toward the opening of the staple-discharging port, and the staple unit is further fired to eject.

This conventional stapler is only loaded with the strip staple unit of the same length. Once this strip staple unit is used up, a new strip staple unit should be reloaded, which is considerably inconvenient and a waste of time in extensive use.

SUMMARY OF THE INVENTION

It is the main object of the present invention to disclose a repeating nail-feeding structure for a pneumatic nailing machine fulfilling the requirement of extensive use.

For achieving the above object, the present invention provides a repeating nail-feeding structure for a pneumatic nailing machine, installed in the pneumatic nailing machine, the pneumatic nailing machine having a magazine loaded with a strip nail, a nail-discharging head connected to the magazine and receiving the strip nail to be ejected, an air inlet connected to an air pressure source, a pushing part turning on the air pressure source for supplying a working air stream, and an air outlet discharging the working air stream.

Further, the nail-feeding structure comprises an air stream guiding tube, an automatic return cylinder, and a shifting element, in which the air stream guiding tube is provided with a first end and a second end. The first end is coupled with the air outlet to receive the working air stream discharged through the air outlet. The automatic return cylinder is fixed to the pneumatic nailing machine, and provided with a cylinder pipe, a piston stein and a return spring. The cylinder pipe is provided with an air stream inlet coupled with the second end, and an air escape outlet discharging the working air stream. The piston stein is passingly provided within the cylinder pipe, as well as shifted to a retracted position through the working air stream coining from the air outlet, and returned to an extended position through the pressing of the return spring. The shifting element is fixed to the piston stein, and provided with a shifting lever. The shifting lever is allowed to advance the strip nail along with motion of the piston stein.

Accordingly, when the pushing part is pushed by a user, the working air stream is then generated, such that the strip nail is ejected out of the nail-discharging head due to the impulsive force of the working air stream. Further, the used working air stream may be discharged through the air outlet, and then guided into the automatic return cylinder by the air stream guiding tube, so as to shift the piston stein to a retracted position. At the moment, the piston stein is then returned to the extended position through the return spring. Thereby, the shifting lever is allowed to advance the strip nail along with back-and-forth motion of the piston stein.

DETAILED DESCRIPTION OF THE PREFERRED EMBODIMENTS

The detailed description and technical content of the present invention will be described, in conjunction with drawings, as follows.

Figure 1:
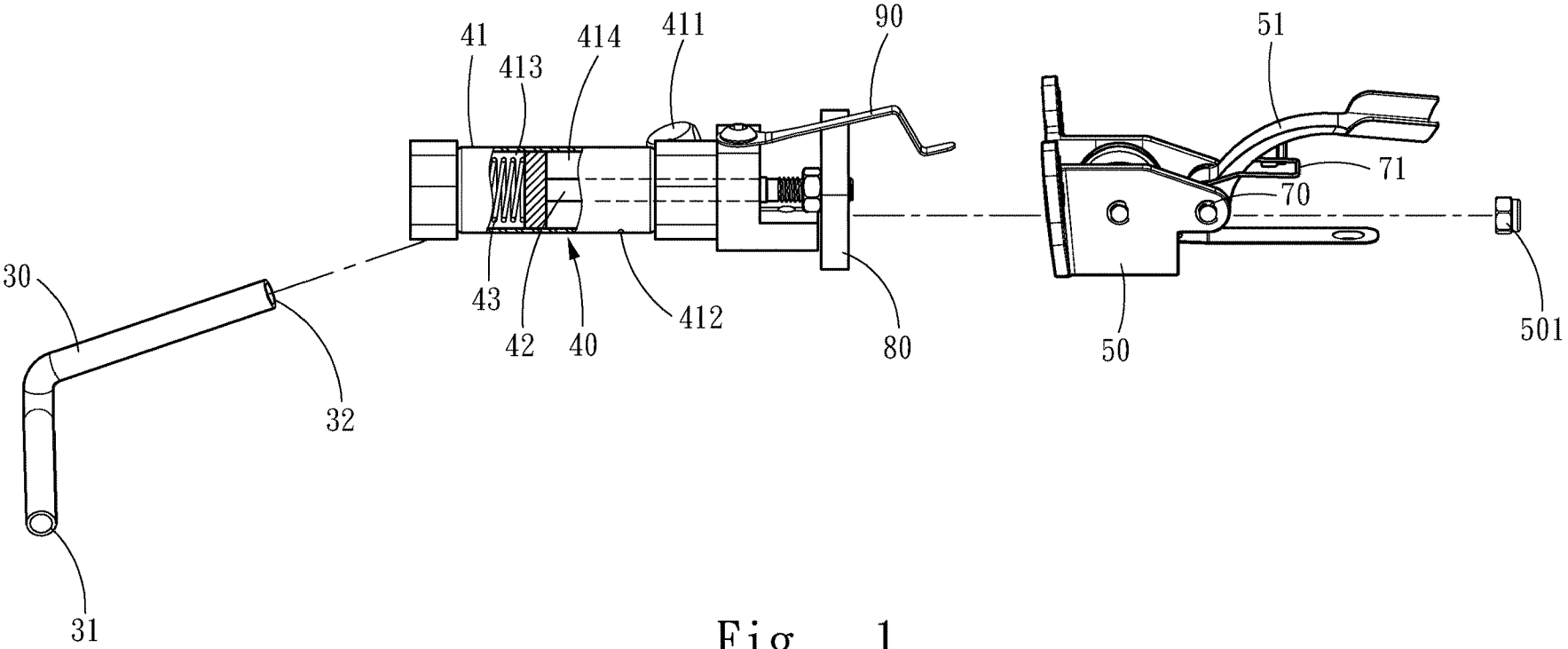
FIG. 1 is a structural exploded view of the present invention.
Figure 2:
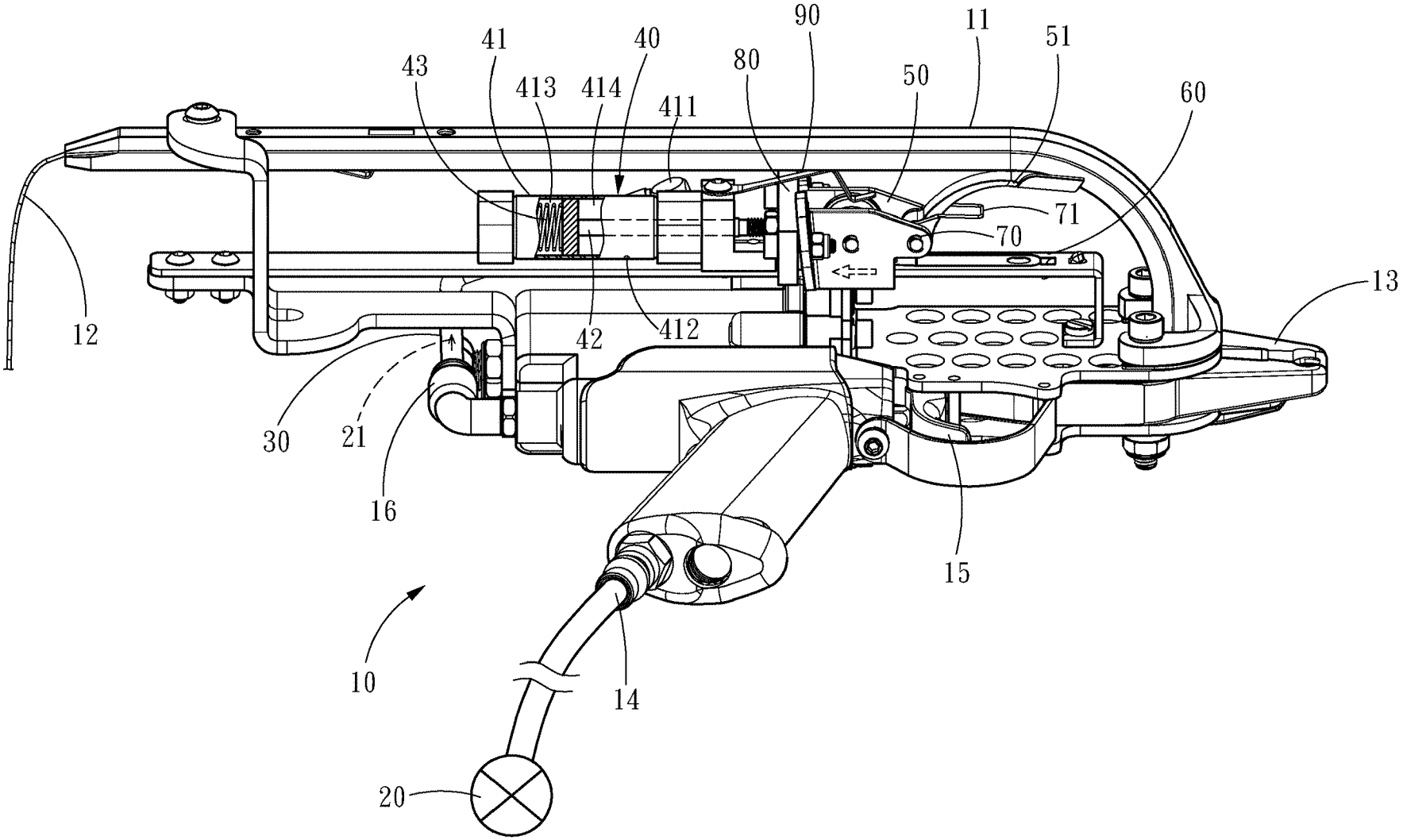
FIG. 2 is a diagram illustrating a first state of one preferred embodiment of the present invention.

Referring to FIG. 1 and FIG. 2, there are shown a structural exploded view and a diagram illustrating a first state of one preferred embodiment of the present invention. As illustrated in the figures, the present invention is a repeating nail-feeding structure for a pneumatic nailing machine 10, installed in the pneumatic nailing machine 10, the pneumatic nailing machine 10 including a magazine 11 loaded with a strip nail 12, a nail-discharging head 13 connected to the magazine 11 and receiving the strip nail 12 to be ejected, an air inlet 14 connected to an air pressure source 20, a pushing part 15 turning on the air pressure source 20 for supplying a working air stream 21, and an air outlet 16 discharging the working air stream 21.

The nail-feeding structure comprises an air stream guiding tube 30, an automatic return cylinder 40, and a shifting element 50, in which the air stream guiding tube 30 is provided with a first end 31 and a second end 32. The first end 31 is coupled with the air outlet 16 to receive the working air stream 21 discharged through the air outlet 16. The air stream guiding tube 30 may be made of a common high-pressure-resistant tube, such as glass fiber woven tube and so on.

Figure 3:
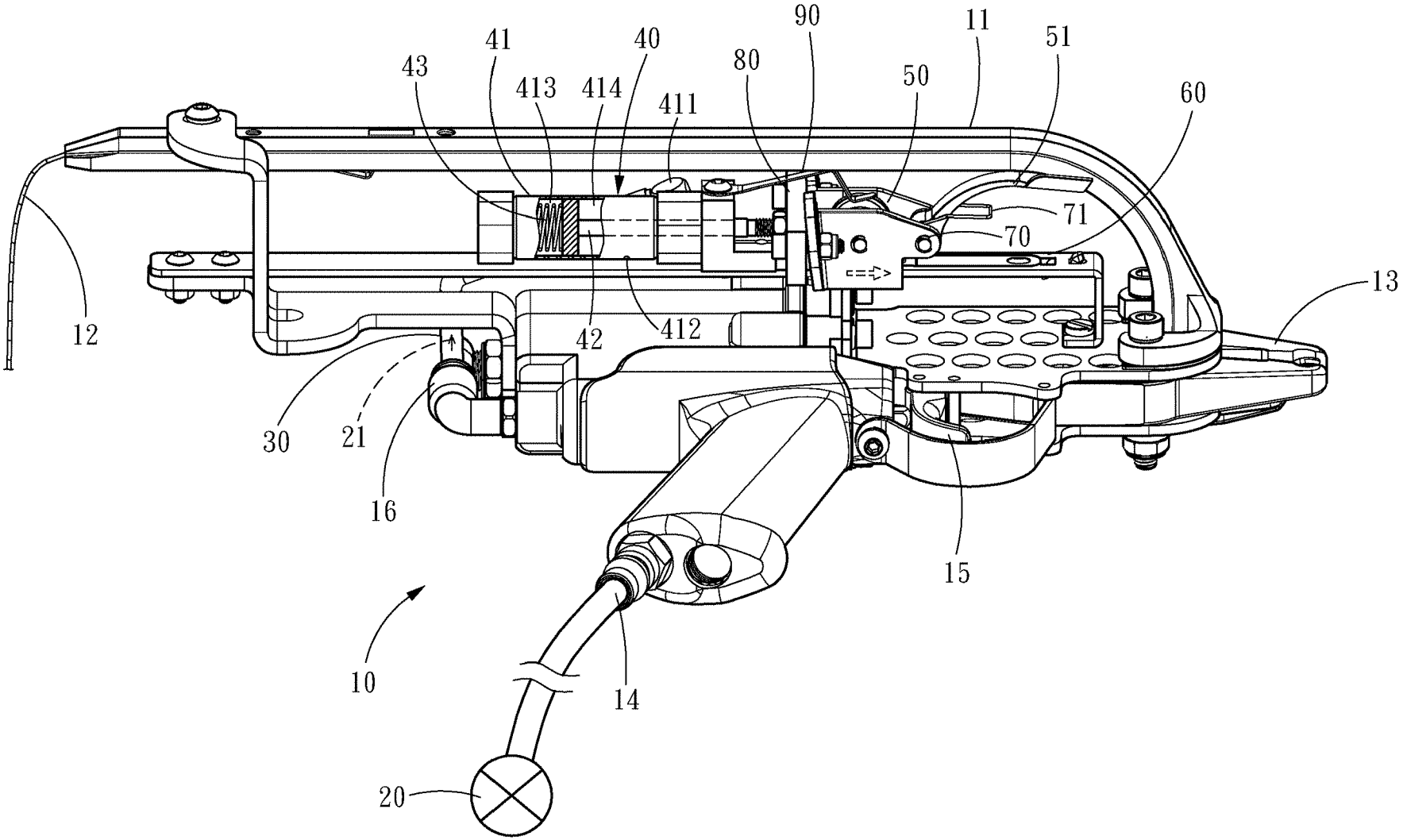
FIG. 3 is a diagram illustrating a second state of one preferred embodiment of the present invention.

Referring to FIG. 3 together, the automatic return cylinder 40 is fixed to the pneumatic nailing machine 10, and provided with a cylinder pipe 41, a piston stein 42 and a return spring 43. The cylinder pipe 41 is provided with an air stream inlet 411 coupled with the second end 32, and an air escape outlet 412 discharging the working air stream 21. The piston stein 42 is passingly provided within the cylinder pipe 41 and shifted to a retracted position (as illustrated in FIG. 2) through the working air stream 21 coining from the air outlet 16, as well as returned to an extended position (as illustrated in FIG. 3) through the pressing of the return spring 43. In the practical structure, the piston stein 42 of the automatic return cylinder 40 is passingly provided within the cylinder pipe 41, and allowed for separating the cylinder pipe 41 into a spring region 413 and an air chamber region 414. The air stream inlet 411 and the air escape outlet 412 are located in the air chamber region 414, while the return spring 43 is compressed to be accommodated in the spring region 413 and then press the piston stein 42 toward the extended position. Accordingly, when the working air stream 21 enters the air chamber region 414, the piston stein 42 is pressed to move to the retracted position (as illustrated in FIG. 2), while the return spring 43 is compressed, due to incapability of instantaneous drainage through the air escape outlet 412. Nevertheless, when the working air stream 21 is drained through the air escape outlet 412 gradually, the piston stein 42 is shifted, by the return spring 43 via elastic force, so as to return to the extended position (as illustrated in FIG. 3).

Further, the shifting element 50 may be fixed to the piston stein 42 by screwing a nut 501, and provided with a shifting lever 51. In the practice of the present invention, a slide rail 60 provided in the pneumatic nailing machine 10 is further included. The shifting element 50 is slidingly provided on the slide rail 60. Moreover, the shifting lever 51 may be pivotally connected to the shifting element 50, and driven by a torsion spring 70 to rotate up to a position abutting against the strip nail 12. The torsion spring 70 is provided with a drawing rod 71 adjusting a placement angle. In other words, the placement angle of the torsion spring 70, i.e., the force abutting against the strip nail 12 by the shifting lever 51, may be changed through the drawing rod 71. The shifting element 50 may be moved back and forth along with the piston stein 42. Therefore, the shifting lever 51 is allowed to advance the strip nail 12 along with motion of the piston stein 42. In the practice, the piston stein 42 may be screwed to a fixing plate 80, while the shifting element 50 is fixed to the fixing plate 80. Thereby, it is possible for the piston stein 42 to drive the shifting element 50 to move successfully.

In addition, the present invention may further include a retaining rod 90. The retaining rod 90 is fixed at one end thereof to the automatic return cylinder 40, while is abutted at the other end thereof against the strip nail 12, such that only one-way motion toward the nail-discharging head 13 is allowed for the strip nail 12. When the shifting lever 51 is moved back (away from the nail-discharging head 13), the strip nail 12 is sustained by the retaining rod 90 without moving back. Thus, when the shifting lever 51 is moved back and forth, the strip nail 12 is then shifted to move toward the nail-discharging head 13 successfully.

To sum up, the working air stream generated when the pushing part is pushed by a user is retrieved in the present invention. More specifically, after the strip nail is ejected out of the nail-discharging head by the working air stream, the used working air stream will be discharged through the air outlet and then guided into the automatic return cylinder by the air stream guiding tube, whereby the piston stein is shifted to the retracted position. Subsequently, the piston stein is returned to the extended position through the return spring. In other words, the working air stream discharged after each ejection of nail from the nail-discharging head is allowed to shift the piston stein to move back and forth once. Thus, the shifting lever may be moved back and forth along with the piston stein, so as to advance the strip nail in succession. Therefore, the strip nail loaded in the present invention may fulfill the requirement of extensive use without limitation to length.

What is claimed is:

1. A repeating nail-feeding structure for a pneumatic nailing machine, installed in said pneumatic nailing machine, said pneumatic nailing machine having a magazine loaded with a strip nail, a nail-discharging head connected to said magazine and receiving said strip nail to be ejected, an air inlet connected to an air pressure source, a pushing part turning on said air pressure source for supplying a working air stream, and an air outlet, wherein said strip nail is ejected out of said nail-discharging head by said working airstream, said entire working air stream becomes a used working air stream, and said used working air stream is discharged by the air outlet, said repeating nail-feeding structure comprising:

an air stream guiding tube, said air stream guiding tube being provided with a first end and a second end, said first end being coupled with said air outlet to receive said used working air stream discharged through said air outlet;

an automatic return cylinder, said automatic return cylinder being fixed to said pneumatic nailing machine, and provided with a cylinder pipe, a piston stem and a return spring, said cylinder pipe being provided with an air stream inlet coupled with said second end and an air escape outlet discharging said used working air stream, said piston stem being passingly provided within said cylinder pipe and shifted to a retracted position through said used working air stream coming from said air outlet, as well as returned to an extended position through the pressing of said return spring; and a shifting element, said shifting element being fixed to said piston stem and provided with a shifting lever, said shifting lever advancing said strip nail along with motion of said piston stem.

2. The repeating nail-feeding structure according to claim 1, wherein said piston stem of said automatic return cylinder is passingly provided within said cylinder pipe, and allowed for separating said cylinder pipe into a spring region and an air chamber region, said air stream inlet and said air escape outlet being located in said air chamber region, while said return spring being compressed to be accommodated in said spring region and then press said piston stem toward said extended position.

3. The repeating nail-feeding structure according to claim 1, further including a retaining rod, said retaining rod being fixed at one end thereof to said automatic return cylinder, while being abutted at the other end thereof against said strip nail, such that only one-way motion toward said nail-discharging head is allowed for said strip nail.

4. The repeating nail-feeding structure according to claim 1, wherein said piston stem is screwed to a fixing plate, said shifting element being fixed to said fixing plate.

5. The repeating nail-feeding structure according to claim 1, wherein said shifting lever is pivotally connected to said shifting element, and driven by a torsion spring to rotate up to a position abutting against said strip nail.

6. The repeating nail-feeding structure according to claim 5, wherein said torsion spring is provided with a drawing rod adjusting a placement angle.

7. The repeating nail-feeding structure according to claim 1, further including a slide rail provided in said pneumatic nailing machine, said shifting element being slidingly provided on said slide rail.

* * * * *